US006076907A

United States Patent [19]

Ambrozy

[11] Patent Number: 6,076,907

[45] Date of Patent: Jun. 20, 2000

[54] DRAWER BRACE

[76] Inventor: Rel S. Ambrozy, 2130 Haycock Rd., Falls Church, Va. 22043

[21] Appl. No.: 08/828,064

[22] Filed: Mar. 26, 1997

[51] Int. Cl.[7] ..... A47B 88/00

[52] U.S. Cl. ..... 312/317.3; 312/235.1; 248/162.1

[58] Field of Search ..... 312/317.3, 235.1, 312/235.3, 317.1, 282, 319.1, 319.2, 249.9, 249.11; 108/33, 143, 93, 115; 248/162.1, 170, 408, 188.1, 188.6

[56] References Cited

U.S. PATENT DOCUMENTS

| | | | |
|---|---|---|---|
| 489,951 | 1/1893 | Hartsock | 312/282 X |
| 2,679,658 | 6/1954 | McCormick | 312/235.1 X |
| 3,701,577 | 10/1972 | Fischer | 312/334.12 |
| 4,318,575 | 3/1982 | Redlich | 312/249.9 |
| 4,345,758 | 8/1982 | Kempf | 108/33 X |
| 4,545,628 | 10/1985 | Richey | 312/235.1 |
| 4,590,709 | 5/1986 | Katsman et al. | 312/276 X |
| 5,478,035 | 12/1995 | Kneile | 248/188.6 |
| 5,716,113 | 2/1998 | Plourde | 312/317.3 X |
| 5,755,498 | 5/1998 | Cutler | 312/278 X |

FOREIGN PATENT DOCUMENTS

| | | | |
|---|---|---|---|
| 127545 | 3/1932 | Austria | 248/188.6 |
| 563483 | 9/1958 | Canada | 312/317.3 |
| 2459638 | 1/1981 | France | 312/334.15 |
| 626748 | 3/1936 | Germany | 248/188.6 |

*Primary Examiner*—Janet M. Wilkens

[57] ABSTRACT

A brace that offers additional support to drawers attached to a roller-brace assembly when the weight or downward force exerted on those drawers potentially exceeds the strength of the roller-brace assembly.

7 Claims, 7 Drawing Sheets

DRAWER BRACE

FIELD OF THE INVENTION

The invention relates to a support which offers additional support to the roller-brace assembly that holds retractable drawers.

RELATED PRIOR ART

Modern day kitchen cabinets and file cabinets are designed to store and or hide all sorts of items such as trash containers, pots and pans or files. Opening the door of a typical kitchen cabinet reveals a drawer which is connected to the cabinet by a brace equipped with rollers. It is this drawer upon which the pots and pans or trash container rests. Rolling the drawer out of the cabinets allows pots and pans to be placed on or removed from the drawer. Similarly, rolling the drawer out of the cabinet allows the user to place trash inside or remove a bag of trash from the trash container. Once all the trash has been inserted or removed from the trash container, the drawer is rolled back into the cabinet and the door closed.

With the advent of food disposals built into the kitchen sink, food waste is rarely thrown into the trash container. Because the items that are actually thrown in the trash container do not spoil rapidly, the time span between removing full bags of refuse from the trash container and taking them outside of the house for trash collection has increased. Consequently, more trash is typically forced or squeezed into the trash container. Because squeezing additional trash into the container requires a downward compacting force, at some point the amount of force required to compact additional trash into the container exceeds the strength of the rollers and brace on which the drawer rests. Unfortunately, this additional downward force results in the rollers and/or brace breaking.

Similarly, as the popularity of cooking continues to increase, more people are buying cookware that is consistently more durable. Unfortunately, this cookware is also heavier, thereby creating additional stress on the roller-brace assembly whenever the drawer holding the cookware is rolled out of the cabinet. Accordingly, there is a need for a support or brace that aids the roller-brace assembly when a downward force is applied to the trash container. Such a device would absorb most of the downward force typically exerted on the roller-brace assembly on which the drawer rests whenever the drawer is pulled out of the cabinet. The same applies to file cabinets as well.

In light of the foregoing, there exists a need for a support or brace that would prevent the rollers or brace on which the drawer rests from bending and or breaking.

SUMMARY OF THE INVENTION

Accordingly, the present invention is directed to a support or brace which substantially overcomes one or more of the above mentioned problems arising from limitations and disadvantages of the related art.

To achieve these and other advantages and in accordance with the purpose of the invention, as embodied and broadly described, one embodiment of the invention is an inflexible support attached to the bottom portion of the drawer that rests just slightly above the floor of the room where it is used to support the drawer.

To achieve these and other advantages and in accordance with the purpose of the invention, as embodied and broadly described, another embodiment of the invention is a flexible support that attaches to the bottom portion of the drawer which is typically folded when the cabinet is closed but unfolds into a vertical position so that it rests just slightly above the floor of the room where it is used to support the drawer.

It is to be understood that both the foregoing general description and the following detailed description are exemplary and explanatory and are intended to provide further explanation of the invention as claimed.

BRIEF DESCRIPTION OF THE INVENTION

The foregoing and other objects, aspects, and advantages will be better understood from the following detailed description of a preferred embodiment of the invention with reference to the drawings, in which:

FIG. 1*a* is a side view of the inflexible support attached to the bottom portion of the drawer.

FIG. 1*b* is a frontal view of the inflexible support attached to the bottom portion of the drawer.

Figure 4A:
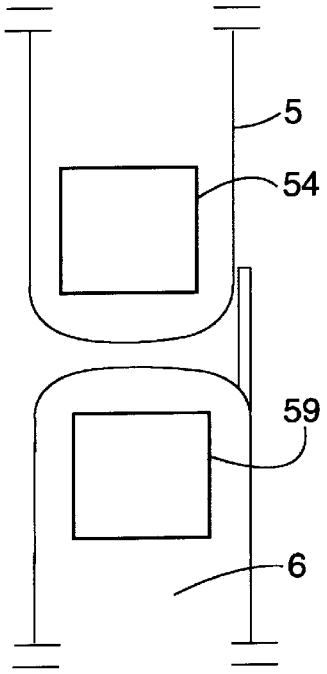

FIG. 4*a* is an exploded side view of the flexible support.

Figure 4B:
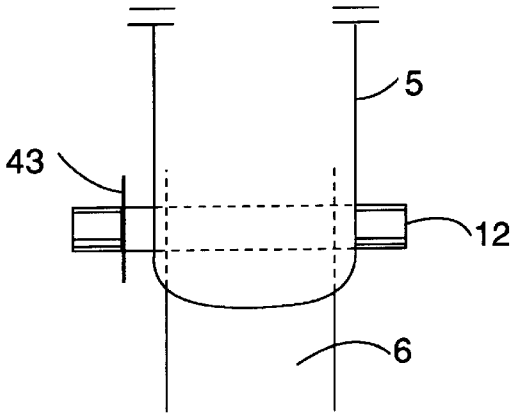

FIG. 4*b* is a head-on view of the assembled flexible support.

Figure 4C:
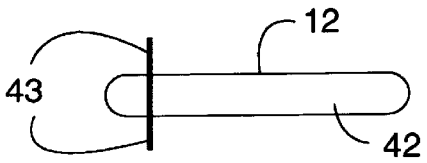

FIG. 4*c* is a side view of the joining pin.

Figure 4D:
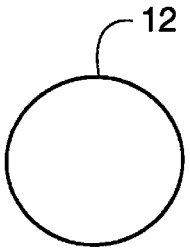

FIG. 4*d* is a head on view of the rounded joining pin.

Figure 5A:
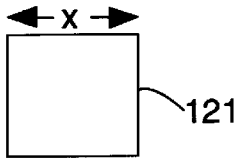

FIG. 5*a* is a head-on view of the squared joining pin.

Figure 5B:
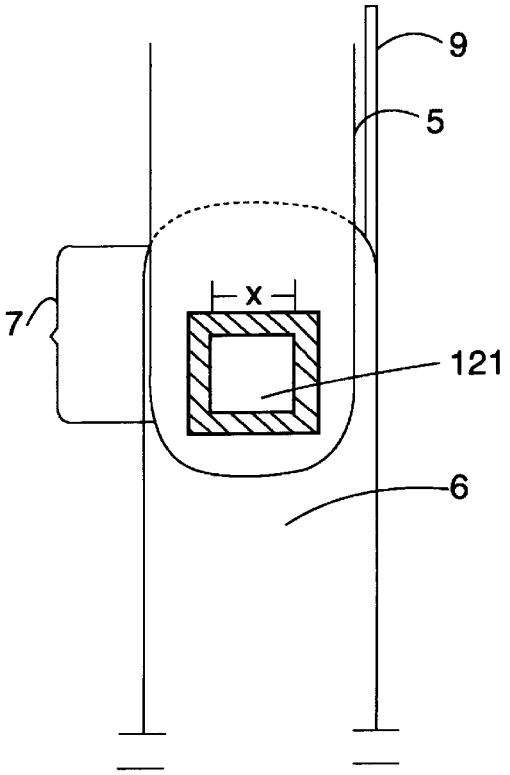

FIG. 5*b* is a side view of the collapsible support.

Figure 5C:
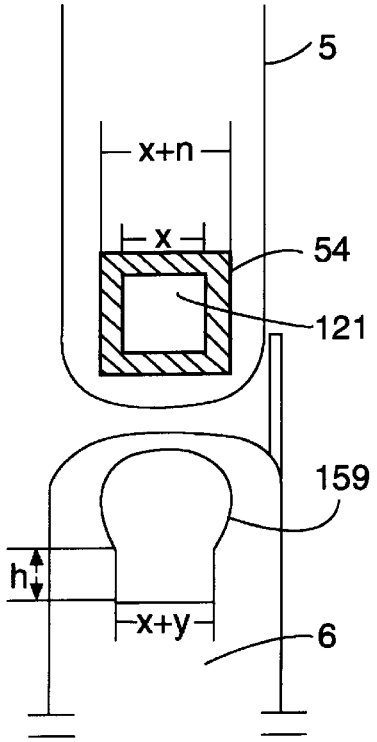

FIG. 5*c* is an exploded side view of the collapsible support.

Figure 5D:
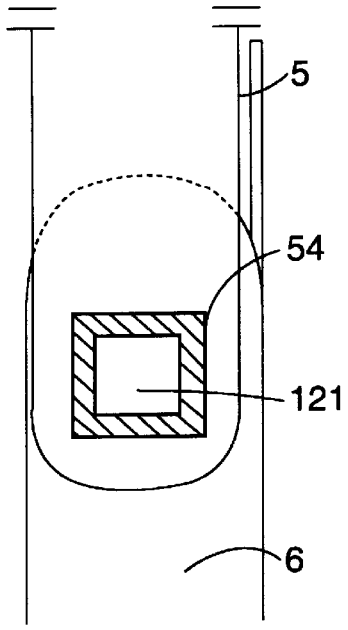

FIG. 5*d* is a side view of the assembled flexible support.

Figure 5E:
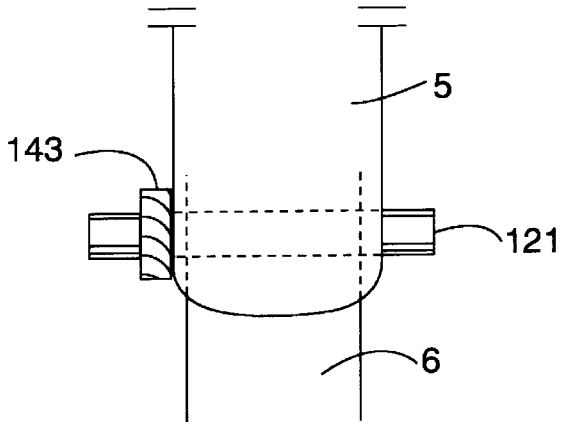

FIG. 5*e* is a head-on view of the assembled flexible support.

Figure 5F:
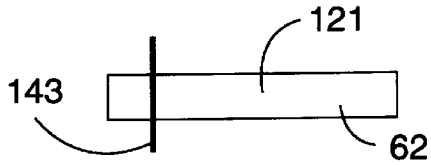

FIG. 5*f* is a side view of the square joining pin.

DETAILED DESCRIPTION OF EMBODIMENTS OF THE INVENTION

Figure 1A:
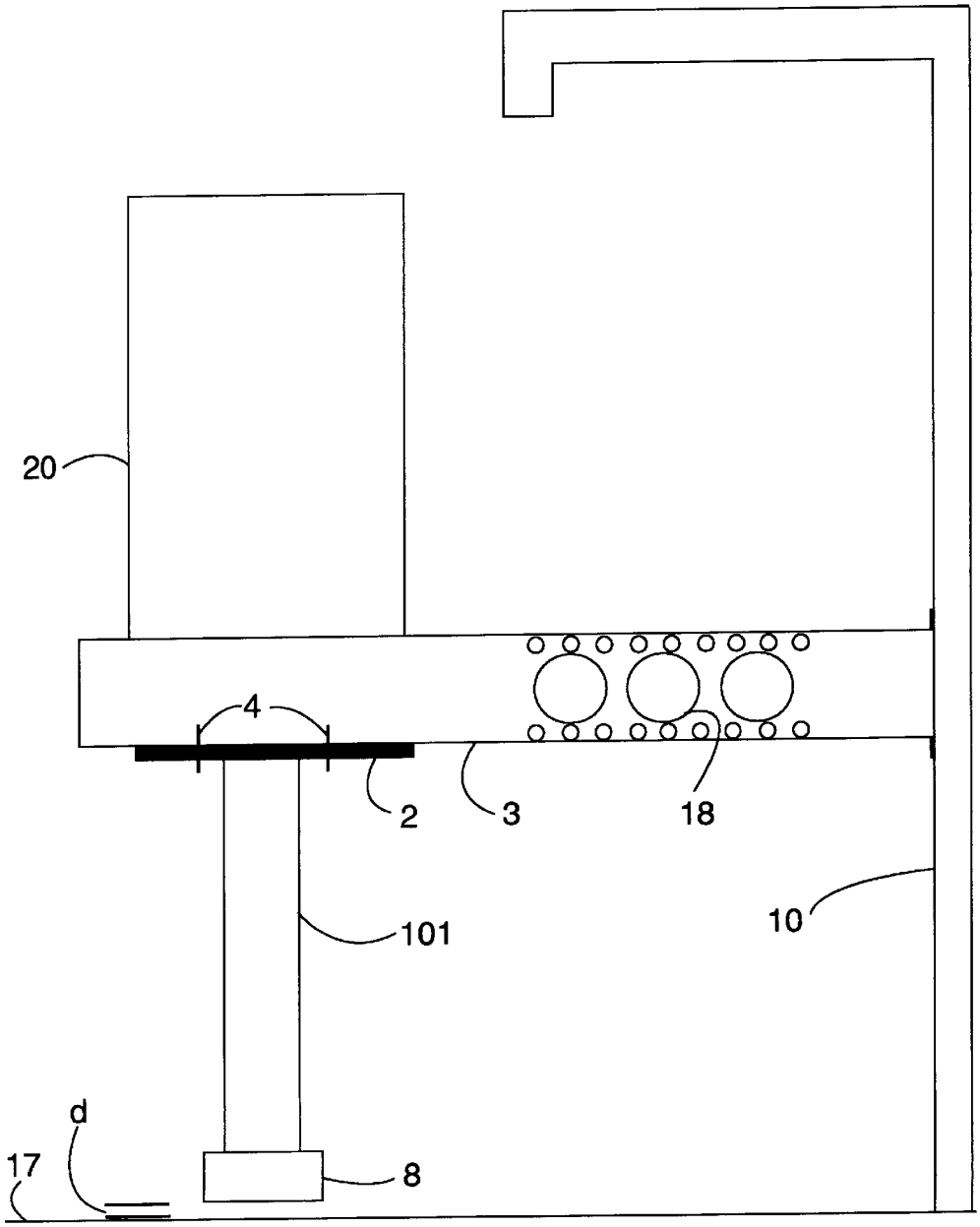

Referring now to the drawings, and more specifically to FIG. 1*a*, there is shown a side view of an embodiment of the present invention, an inflexible drawer support 101. All elements in this embodiment of the inflexible support 101, like all elements in the flexible support embodiments to follow, are preferably made of metal, except as otherwise discussed. However, other materials such as plastic, wood, and fiberglass can also be used. This first embodiment, as shown in FIG. 1*a*, is made by punching the inflexible support from sheet metal and stamping it into its required shape. Similarly, for the embodiments to follow, the individual members of the flexible supports are also punched from sheet metal and stamped into their required shape, except as otherwise discussed. Other methods of making the supports, such as forging, could also be used.

The embodiment of the inflexible drawer support 101, as shown in FIG. 1*a*, consists of, among other elements, a metal top plate 2 which is also punched from sheet metal. The bottom portion of the top plate 2 is spot welded to the upper portion of the inflexible drawer support 101. The upper portion of the top plate 2 is attached to the bottom portion of the drawer 3 by screws, nails, or bolts 4. Glue could also be used. The drawer 3, in turn, is attached to the cabinet 10 by a roller-brace assembly 18. At the bottom portion of the inflexible support 101 is a rubber or plastic cap 8 that prevents the inflexible support 101 from scratching the floor 17.

As shown in FIG. 1*a*, as the drawer 3 is pulled out of the cabinet 10, the inflexible support 101 moves out of the cabinet 10. Note that in this embodiment and as shown in FIG. 1*a*, the length of the inflexible support 101 is just short of equaling the distance from the bottom of the drawer 3 to the floor 17. This allows the drawer 3 to move freely on the roller-brace assembly 18 and not be inhibited by friction between the cap 8 and the floor 17. However, the distance between the bottom of the cap 8 and the floor 17, shown as d in FIG. 1*a*, should be as small as possible so that when a downward force is directed into the trash container 20, or similarly as additional pots are added to the drawer 3, the inflexible drawer support 101 only travels the distance d to meet the floor 17 thereby preventing damage to the drawer 3 and the roller-brace assembly 18. Once the trash has been inserted and compressed into the container 20 and the downward compacting force ends, or additional pots are placed on the drawer 3 and the drawer 3 no longer needs to be outside the cabinet 10, the drawer 3 can be inserted back into the cabinet 10.

Figure 1B:
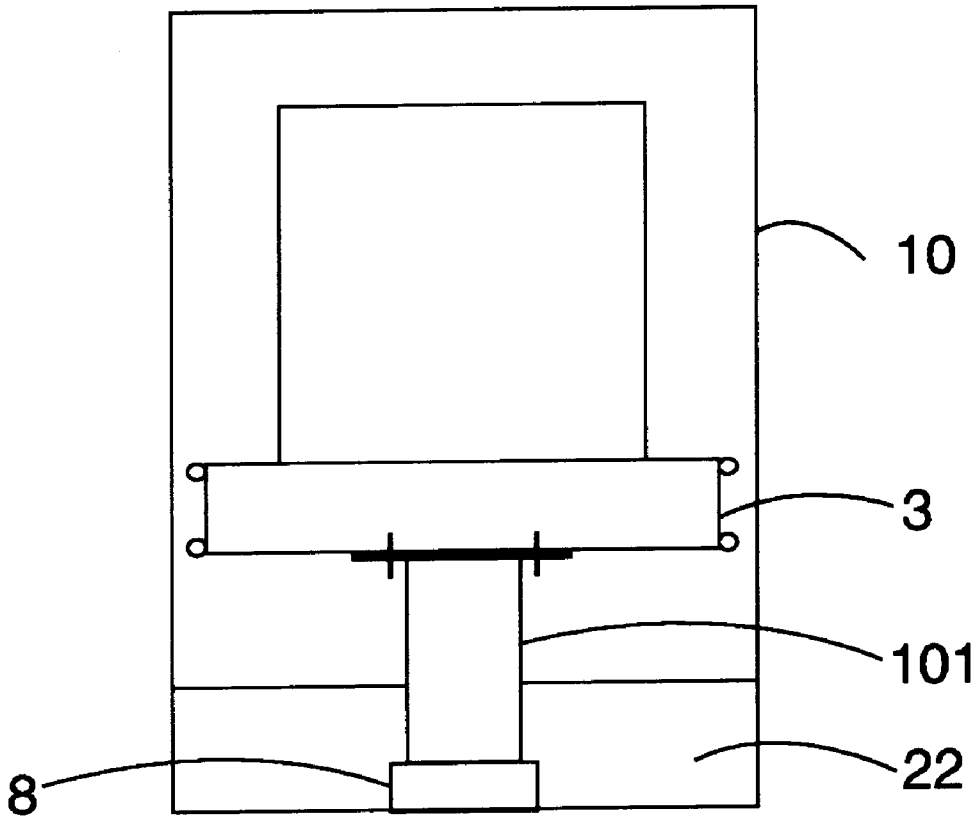

As can be seen from FIG. 1*b*, the base 22 of a front portion of the cabinet 10 is cut out so that when the drawer 3 is entirely inside the cabinet 10, the inflexible support 101 is flush with the base 22 of the cabinet 10. Ensuring the inflexible brace 101 is mounted to the drawer 3 so that it is flush with the base 22 of the cabinet 10 creates a favorable appearance in the cabinet 10.

Figure 2:
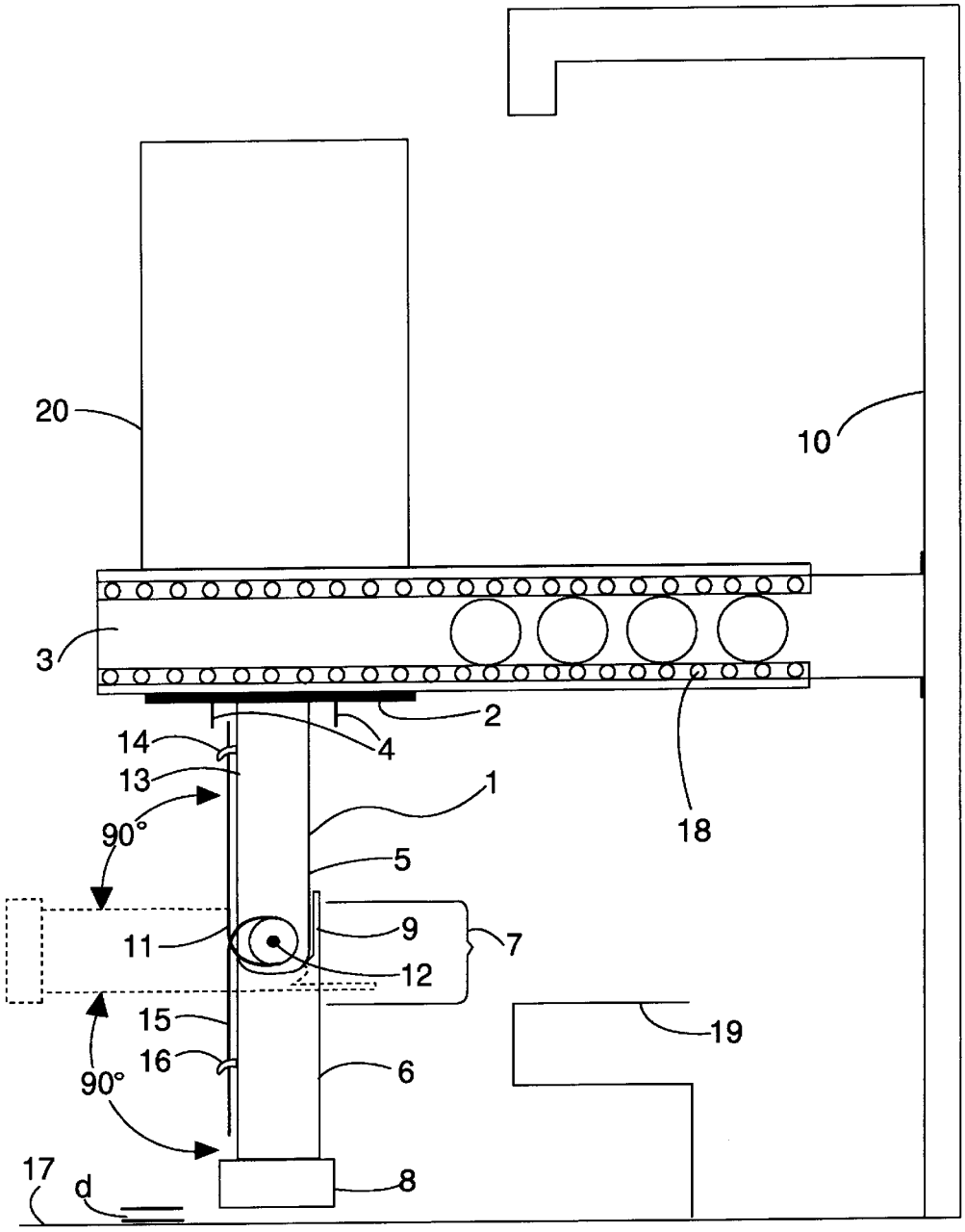
FIG. 2 is a side view of one embodiment of the flexible support.

Referring now to the other drawings, and more specifically to FIG. 2, there is shown a side view of another embodiment of the present invention, a flexible metal drawer support 1. This embodiment of the flexible drawer support 1 consists of, among other elements, a metal top plate 2, which is punched from sheet metal. The upper portion of the top plate 2 is attached to the bottom portion of the drawer 3 by screws, nails, or bolts 4. Glue could also be used. The drawer 3 is attached to the cabinet 10 by a roller-brace assembly 18.

The top portion of the upper support 5 is attached to the bottom portion of the top plate 2. This attachment can be achieved by either having the top plate 2 and upper support 5 forged as one piece or, as in the preferred embodiment, the upper support 5 is preferably punched from sheet metal, stamped into shape, and then its top portion is spot welded to the bottom portion of the top plate 2. The bottom portion of the upper support 5 is joined to the upper portion of the lower support 6 by a pin 12. The lower support 6 is preferably punched from sheet metal and stamped into shape. The pin 12 is preferably made of forged metal, but can be machined as well. The joiner of the upper support 5 and the lower support 6 by the pin 12 forms an elbow joint 7. This elbow joint 7 allows the lower support 6 to rotate around the pin 12. Any other similar joint known in the art to be flexible yet sturdy could also be used. Friction fit to the bottom portion of the lower support 6 is a rubber or plastic cap 8 that prevents the flexible drawer support 1 from scratching the floor 17.

Note that the elbow joint 7 should be flexible in only one range of movement. As shown in FIG. 2, the elbow joint 7 should only allow the lower support 6 to move in the up and down position to the left of center of the elbow joint 7. Moreover, to ensure stability of the flexible support 101, the elbow joint 7, when extended as shown in FIG. 2, should not allow the lower support 6 to move to the right of center of the elbow joint 7. This restriction can be enforced by a metal spur 9 which is preferably punched from sheet metal and is spot welded to the back side of the upper portion of the lower support 6. The spur 9 should reach past the entire elbow joint 7 so that it can meet the upper support 5 at some point above the elbow joint 7 once the lower support is fully extended.

It may help to picture the flexible drawer support 1 shown in FIG. 2 as the hands of a clock. With the center of the clock positioned on the pin 12, the upper support 5 is always fixed at the twelve on the clock. When the drawer is inside the cabinet 10 the lower support 6 is flexed and would point towards the nine on the clock. As the drawer 3 is withdrawn from the cabinet 10, the lower support 6 moves from the nine on the clock face towards the six on the clock face. Once the upper support 5 is completely past the plate 19, which is attached to the cabinet 10, the lower support 6 is fully extended, pointing towards the six on the clock. Put another way and as illustrated in FIG. 2, the lower support 6 when flexed and stored in the cabinet 10 forms about a 90 degree angle with the upper support 5, and when it is fully extended outside the cabinet 10, it creates about a 180 degree angle with the upper support 5.

It is the plate 19 that causes the lower support 6 to flex when the drawer 3 is inside the cabinet 10. When the lower support 6 is fully flexed, the cap 8 on the lower portion of the lower support 6 rests against the plate 19. As the cap 8 and the lower support 6 exit the cabinet 10, they would move along and past the plate 19 allowing the cap 8 and the bottom portion of the lower support 6 to begin to move towards the floor 17.

Several means can be used to cause the flexible support 1 to expand as the drawer 3 is removed from the cabinet 10, resulting in the lower support 6 moving to the 180 degree angle. In one embodiment and as shown in the side view of FIG. 2 and the frontal view of FIG. 3, a spring 11 is positioned vertically on the flexible drawer support 1. This spring 11 is centered around the pin 12 of the elbow joint 7, i.e., the pin 12 passes through the coils of the spring 11. The top arm 13 of the spring 11 is positioned on the upper support 5 and is kept in place with a retainer 14. The retainer 14 can be created in the upper support 5 by punching a small hole in the upper support 5 so as to create a semi-circular rise or retainer 14 in which the upper arm 13 of the spring 11 can be inserted. The bottom arm 15 of the spring 11 is similarly inserted in a retainer 16 similarly created in the lower support 6. The spring 11 is designed and arranged on the flexible support 1 so that its expansive force is directed onto the upper support 5 and the lower support 6, thereby forcing these supports apart.

As discussed above and in reference to FIG. 2, as the drawer 3 is pulled out of the cabinet 10, the expansive force of the spring 11 forces the lower support 6 to move from the 90 degree angle to the 180 degree angle it forms with the upper support 5, fully expanding or extending the flexible drawer support 1. The spring 11 and the spur 9 work in concert to keep the fully extended flexible drawer support 1 at approximately 180 degrees. This is accomplished by the spring 11 forcing the lower support 6 towards or past an angle of 180 degrees while the spur 9 keeps the lower support 6 from moving past an angle of approximately 180 degrees. This dual opposing action on the lower support 6 reduces its ability to move laterally when a downward force that is not 180 degrees vertical is applied to the drawer 3, thereby resulting in additional support for the roller-brace assembly 18 and the drawer 3. Both FIG. 1*a* and FIG. 2 disclose that the inflexible support 101 and the flexible drawer support 1, respectively, are spaced apart from the front face of the drawer 3.

Note that in this embodiment and as shown in FIG. 2, the length of the spring-flexed drawer support 1 is just short of equaling the distance from the bottom of the drawer 3 to the floor 17. This allows the drawer 3 to move freely on the roller-brace assembly 18 and not be inhibited by friction between the cap 8 and the floor 17. However, the distance between the bottom of the cap 8 and the floor 17, shown as d in FIG. 2, should be as small as possible so that when a downward force is directed into the trash container 20, additional pots are added to the drawer 3, or additional files are added to the drawer 3, the flexible drawer support 1 in the fully extended position only travels the distance d to meet and come into contact with the floor 17, thereby preventing damage to the drawer 3 and the roller-brace assembly 18.

Once the trash has been inserted and compressed into the container 20 and the downward compacting force ends, or similarly as additional pots are added to the drawer 3, and the drawer no longer needs to be outside the cabinet 10, the drawer 3 can be inserted back into the cabinet 10. Pushing the drawer 3 into the cabinet 10 causes the lower support 6 to come into contact with the plate 19. As additional force is applied to the drawer 3 to push it into the cabinet 10, additional force is transferred or applied to the lower support 6. When the force applied in pushing the drawer 3 into the cabinet 10 is greater than the expansive force in the spring 11, it will result in the lower support 6 compressing the spring 11, thereby allowing the lower support 6 to rotate from the 180 degree angle towards the 90 degree angle. Once the drawer 3 is completely inside the cabinet 10, the lower support 6 and the cap 8 rest against the plate 19 until the drawer 3 is again withdrawn.

Figure 3:
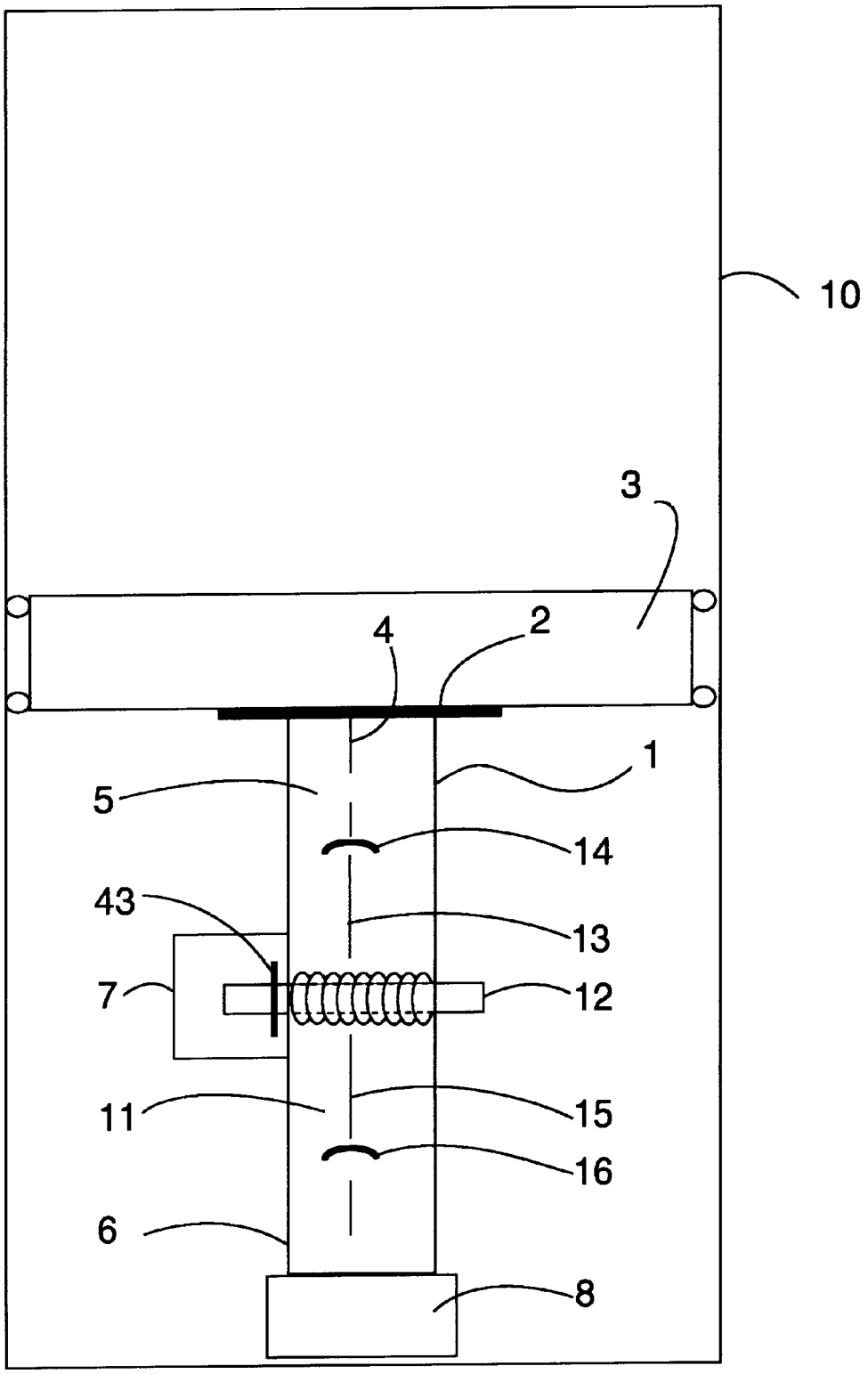
FIG. 3 is a frontal view of one embodiment of the flexible support.

The flexible support 1 is preferably assembled as follows and results in the creation of the elbow joint 7. The top arm 13 of the spring 11 is inserted into the retainer 14 of the upper support 5. Making sure the expansive force of the top arm 13 of the spring 11 is directed onto the upper support 5, the bottom arm 15 of the spring 11 is pulled around until it is vertical and is then inserted into the retainer 16 of the lower support 6, with the expansive force of the bottom arm 15 directed onto the lower support 6. The lower support 6 is then joined to the upper support 5, as shown in FIG. 3, FIG. 4*a*, and FIG. 4*b* by positioning the upper portion of the lower support 6 inside the lower portion of the upper support 5 so that the square upper support holes 54 align with the square lower support holes 59. Care should be taken to ensure the spur 9 is outside of the upper support 5. Once the two sets of square holes are aligned, and the spring 11 is centered on the joined upper support 5 and lower support 6, the first end 42 of the rounded pin 12, as shown in FIG. 4*c*, is inserted through both sets of the aligned square holes as well as through the center of the spring 11. In this embodiment it is important that the width of pin 12 be rounded or circular in shape, as shown in FIG. 4*d*. The metal stopper 43 that is preferably punched from sheet metal, prevents the rounded pin 12 from traveling completely through the aligned upper 54 and lower support holes 59. The stopper 43 could be made from a friction fit washer that has a round hole cut in the center which approximates the diameter of the rounded pin 12 so that it friction fits on the rounded pin 12 and is then spot welded in place on the rounded pin 12. Once the rounded pin 12 has been inserted through both sets of aligned square holes 54 and 59 as well as the center of the spring 11 so that the stopper 43 rests against the outer portion of the upper support 5, the stopper 43 is spot welded to the upper support 5. Doing so results in the upper support 5 being secured to the lower support 6 thereby locking the spring 11 in place. Of course, other means of attachment known in the art can be use instead of spot welding.

More particularly, there is a need for a flexible or collapsible support that expands when the drawer is withdrawn from the cabinet without the use of a spring to create the expansive force, and compresses even more easily than a spring flexed support so as to allow the drawer to be inserted back into the cabinet with less force.

Reference will now be made to the preferred embodiment of the present invention by referencing mostly the same reference numerals used above expect as otherwise noted. For example, the reference numerals used in FIGS. 2 and 3 above to describe the invention are mostly the same as those used in FIGS. 5*a*, 5*b*, 5*c*, 5*d*, 5*e* and 5*f* except as otherwise discussed. Accordingly, the collapsible or flexible support 1 consists of, among other elements, the top plate 2, the upper support 5, the lower support 6, the pin 121, the stopper 143, and the spur 9, which are all made as described above, except as otherwise discussed. FIG. 5*a* shows a head on view of pin 121 which is square in the preferred embodiment, has a width of (x), and is made as described above. As shown in FIG. 5*b*, the preferred embodiment has an elbow joint 7 which is comprised of the intersection of the upper support 5 and the lower support 6 joined by the squared pin 121. As shown in FIG. 5*c*, the square width (x) of the pin 121 is just slightly smaller than the width (x+n) of the square upper support holes 54 so as to provide a friction fit between the squared pin 121 and the upper support holes 54.

Also, as shown in FIG. 5*c*, the width (x+y) of the bottom square portions of the lower support holes 159 is larger then the width (x) of the squared pin 121 so that the lower support holes 159 closely approximate the width of but do not friction fit with the squared pin 121. The top portions of the lower support holes 159 are even wider than the width (x+y) of the bottom portions of the lower support holes 159. Additionally, the lower support holes 159 as a whole are shaped differently than the upper support holes 54 in that the top portions of the lower support holes 159 are rounded while the bottom portions are square. It is the edged portions of the squared pin 121 that the lower support 6 rotates around. The lower support 6 is joined to the upper support 5, as shown in FIGS. 5*b*, 5*c*, 5*d*, and 5*e*, by first positioning the upper portion of the lower support 6 inside the lower portion of the upper support 5 so that the upper support holes 54 align with the lower support holes 159. Once the two sets of holes are aligned, the first end 62 of the squared pin 121, as shown in FIG. 5*f*, is inserted through both sets of the aligned holes. The metal stopper 143 prevents the squared pin 121 from traveling completely through the aligned upper support holes 54 and the lower support holes 159. The stopper 143 could be made from a friction fit washer that has a square hole cut in the center that matches the square width of the squared pin 121 so closely that it friction fits on the squared pin 121 and is then spot welded in place. Of course, any method known in the art to secure the stopper 143 to the squared pin 121 can be used. Once the squared pin 121 has been inserted so that the stopper 143 rests against the outer portion of the upper support 5, the stopper 143 is spot welded to the upper support 5. Doing so keeps the upper support S secured to the lower support 6. Of course, other means of attachment known in the art can be used instead of spot welding.

As discussed above, while the upper support holes 54 mimic the shape of the squared pin 121 except that they are slightly larger, the lower support holes 159 are circular at their top and square at their bottom. The reason for this is that the circular upper portion of the lower support hole 159 allows the lower support 6 to rotate around the squared pin 121 as the lower support 6 is either being inserted into or withdrawn from the cabinet 10. Once the collapsible support 1 is fully withdrawn from the cabinet 10, the lower support 6 rests on the squared pin 121 where the circular upper portion of the lower support holes 159 come into contact with the squared pin 121.

When a downward force is applied to the withdrawn drawer 3, the upper support 5 and, therefore, the squared pin 121, move down into the square portion of the lower support holes 159. Once the squared pin 121 enters the square portion of the lower support holes 159, it locks the entire support in place. In other words, the upper support 5 is in effect spot welded to the squared pin 121, and the pin 121 is in turn joined to the lower support 6 because the squared pin 121 fits into the square portion of the lower support holes 159. The closer the width (x+y) of the bottom square portions of the lower support holes 159 matches the width (x) of the squared pin 121, without friction fitting to each other, the better the squared pin 121 will lock in place, and release, when the downward force has ended. Moreover, as shown in FIG. 5*c*, the closer the height h approximates zero, the less distance the squared pin 121 has to move downward in order to be seated in the square portion of the lower support holes 159. Similarly, the closer the distance between the floor 17 and the bottom of a fully extended flexible support 1 including the cap 8 equals substantially zero, the better the flexible or collapsible support 1 will protect the roller-brace assembly 18. In other words, the distance d, which substantially equals the distance the fully extended flexible support 1 including the cap 8 must travel to meet the floor 17, should equal the height h that the bottom portion of the squared pin 121 must travel to meet the bottom of the square portion of the lower support holes 159, as shown in FIGS. 2 and 5*c*.

Note that the elbow joint 7 of the preferred embodiment should be flexible in only one range of movement as described above. As shown in FIG. 5*b*, the elbow joint 7 should only allow the lower support 6 to move in the up and down position to the left of center of the elbow joint 7. Moreover, the elbow joint 7, when extended as shown in FIG. 5*b*, should not allow the lower support 6 to move to the right of center of the elbow joint 7. This restriction can be enforced by a metal spur 9 as discussed above, which is preferably punched from sheet metal and is spot welded to the back of the upper portion of the lower support 6. The spur 9 should reach past the entire elbow joint 7 so that it can meet the upper support 5 at some point above the elbow joint 7 once the lower support 6 is fully extended.

Once the downward compacting force has ended and/or the user begins to put the drawer 3 containing the heavy pots and pans, or other items such as files back into the cabinet 10, the ending of the downward force and/or the force exerted in returning the drawer 3 to the cabinet 10 creates a slight upward force on the drawer 3. This results in the squared pin 121 withdrawing from the lower square portion of the lower support holes 159. As a result the lower support 6 again rests on the squared pin 121 by the circular upper portion of the lower support holes 159. As the drawer 3 is inserted into the cabinet 10 the lower support 6 begins to come in contact with the plate 19. As additional force is applied to the drawer 3 to push it into the cabinet 10, additional force is applied to the lower support 6 by the plate 19. This additional force causes the lower support 6 to rotate on the squared pin 121 via the circular portion of the lower support holes 159. Once the drawer 3 is completely inside the cabinet 10, the lower support 6 and the cap 8 rest against the plate 19 until the drawer 3 is again withdrawn.

It will be apparent to those skilled in the art that various modifications and variations can be made in the described supports as well as the method of the present invention without departing from the scope or spirit of the invention. Moreover, other embodiments of the invention will be apparent to those skilled in the art from consideration of the specification and practice of the disclosed invention herein. The specification and examples are thus only exemplary, with the true scope and spirit of the invention being indicated by the following claims.

I claim:

1. An assembly comprising:

a cabinet disposed on a floor;

a drawer mounted inside the cabinet and movable from inside to outside the cabinet along a roller brace assembly attached to the cabinet; and a brace connected to a bottom of the drawer, spaced apart from a front of the drawer, extending downward toward the floor, whereby when downward force is applied to the drawer positioned outside the cabinet, the brace contacts the floor and supports the bottom of the drawer, the brace comprising an upper portion rigidly connected to the bottom of the drawer, a lower portion rotatably connected at an upper end to a lower end of the upper portion, and a spur integrally formed at the upper end of the lower portion, wherein the spur contacts the upper portion when the lower portion is oriented vertically to prevent over-rotation away from the front of the drawer, and wherein the spur does not contact the upper portion when the lower portion is rotated toward the front of the drawer, whereby rotation away from the front of the drawer beyond a substantially vertical orientation is prevented.

2. The assembly of claim 1, the cabinet further comprising a plate horizontally positioned rearward of a front of the cabinet and vertically positioned below the lower end of the upper portion of the brace, whereby while the drawer is closed the lower portion of the brace is rotated toward the front of the drawer by the plate and when the drawer is positioned inside the cabinet, the lower portion of the brace rests substantially horizontally on the plate.

3. The assembly of claim 1, wherein the upper portion is connected to the lower portion with an elbow joint comprising:

an upper support hole at the lower end of the upper portion;

a lower support hole at the upper end of the lower portion aligned with the upper support hole; and a pin disposed through the upper support hole and the lower support hole.

4. The assembly of claim 3, the elbow joint further comprising a spring coiled around the pin, a first spring end connected to the upper portion and a second spring end connected to the lower portion to apply force tending to rotate the lower portion away from the front of the drawer.

5. The assembly of claim 3, wherein:

the pin is substantially square shaped of a size to prevent substantial rotation of the pin relative to the upper support hole;

the lower support hole has a top portion that is arcuate shaped whereby the lower support hole can rotate relative to the pin; and the lower support hole has a bottom portion that is square shaped of a size to prevent substantial rotation of the lower support hole relative to the pin and of an orientation to fit the square pin when the lower portion of the brace is substantially vertical, whereby when downward force is applied to the drawer when the drawer is positioned outside the cabinet, the square pin moves into the square bottom portion and rotation of the lower portion of the brace is prevented.

6. The assembly of claim 5, wherein a vertical dimension of the bottom square portion of the lower support hole is designated height h;

a vertical distance between a lower end of the lower portion and the floor, when the drawer is positioned outside the cabinet before a downward force is applied to the drawer, is designated distance d; and height h and distance d have a value close to zero.

7. The assembly of claim 1, further comprising a plastic cap covering a lower end of the lower portion, whereby scratching of the floor by the brace is substantially reduced.

* * * * *